US007431074B1

(12) United States Patent
Fellman et al.

(10) Patent No.: US 7,431,074 B1
(45) Date of Patent: Oct. 7, 2008

(54) RADIATOR STRUCTURE

(76) Inventors: Michael L. Fellman, 136 Wright Brothers Ave., Livermore, CA (US) 94550; Walton Smith, 1411 Mandarin Ct., Brentwood, CA (US) 94513

( * ) Notice: Subject to any disclaimer, the term of this patent is extended or adjusted under 35 U.S.C. 154(b) by 121 days.

(21) Appl. No.: 11/384,997

(22) Filed: Mar. 20, 2006

(51) Int. Cl.
*F28F 1/32* (2006.01)
*F28F 1/34* (2006.01)
*F28F 21/02* (2006.01)

(52) U.S. Cl. ..... 165/173; 165/181; 165/905

(58) Field of Classification Search ..... 165/173, 165/175, 181, 182, 905, DIG. 412, DIG. 416, 165/DIG. 444, DIG. 500, DIG. 501
See application file for complete search history.

(56) References Cited

U.S. PATENT DOCUMENTS 4,256,178 A * 3/1981 Fauvel ..... 165/165
4,615,379 A * 10/1986 Kunzel ..... 165/10
4,674,567 A * 6/1987 Keintzel et al. ..... 165/162
4,838,346 A 6/1989 Camarda et al.
5,077,103 A 12/1991 Wagner et al.
5,323,849 A * 6/1994 Korczynski et al. ..... 165/158
5,418,063 A 5/1995 Booth
5,542,471 A 8/1996 Dickinson
5,628,363 A 5/1997 Dewar et al.
5,655,600 A 8/1997 Dewar et al.
5,766,691 A 6/1998 Arnold et al.
5,825,624 A 10/1998 Arnold et al.
5,845,399 A 12/1998 Dewar et al.
5,940,272 A 8/1999 Emori et al.
6,267,175 B1 7/2001 Anderson
6,397,581 B1 6/2002 Vidal et al.
2001/0047862 A1 12/2001 Anderson et al.
2002/0172897 A1 11/2002 Golecki
2003/0056943 A1 3/2003 Dessiatoun et al.
2003/0102117 A1* 6/2003 Murayama et al. ..... 165/185
2006/0272340 A1* 12/2006 Petrenko ..... 62/73

* cited by examiner

*Primary Examiner*—Teresa J Walberg
(74) *Attorney, Agent, or Firm*—Theodore J. Bielen, Jr.

(57) ABSTRACT

A radiator structure used with a hot fluid and cooling fluid having a carbon fiber tube. The carbon fiber tube includes a wall portion having an inner surface and an outer surface. A passageway through the tube is used to conduct hot fluids. A second tube of similar construction is spaced form the first tube. A multiplicity of carbon fiber fins span and connect to the first and second tubes and are held thereto by a conductive adhesive.

24 Claims, 3 Drawing Sheets

RADIATOR STRUCTURE

BACKGROUND OF THE INVENTION

The present invention relates to a novel and useful radiator which is particularly useful to cool a vehicle engine.

A conventional radiator consists of a pair of tanks which are connected to intermediate vertical passages. In general the conventional vehicle radiator are either of a tubular type, consisting of a plurality of tubes to which thin metallic fins are soldered, or are of a cellular form. In the latter instance, cooling fluid passages and air interstices are constructed by soldering preformed sheets of thin material. Water passages are typically smaller in cross-sectional area in the cellular type than in the tubular type radiator. Baffles are also included to distribute water over the end portions of prior radiators to insure even distribution of water throughout a radiator core. In the past, most radiator parts have been made of metallic material such as steel, copper, brass, and the like, in order to employ the relatively high thermal conductivity of such materials. In addition, metallic materials are generally stronger than non-metallic materials.

Recent development in composites have produced materials which are candidates for non-metallic radiator structures. For example, carbon-fiber materials such as PAN pitch fibers, carbon/carbon fibers and the like have been developed. Prior attempts to construct vehicle radiators of such composites have failed due to the fact that carbon fibers are difficult to form into a particular structure possessing integrity.

For example, U.S. Pat. No. 5,418,063, U.S. Patent Application 2002/0172897 and PCT Publication WO 98/03297 describe processes for fabrication of carbon-carbon materials and carbon containing materials which may be woven or formed into hybrid structures with metallic materials.

European Patent Application 0564651 describes use of a carbon-carbon composite material for a protective shield in a space module.

U.S. Pat. Nos. 4,838,346, 5,077,103, 5,766,691, 5,825,624, and 5,940,272 describe heat transferring devices for use in manufacturing systems which employ carbonaceous materials.

U.S. Pat. Nos. 5,542,471 and 6,267,175 show heat transfer elements having thermally conductive fibers which may be used as heat exchangers. The fibers may be composed of carbon containing materials such as carbon-carbon composites and the like.

U.S. Pat. No. 6,397,581 and Patent Application 2001/047862 teach heat exchangers using composite material to form circulation channels. Such exchangers are normally of the plate and corrugation type construction.

U.S. Pat. No. 5,628,363 and United States Patent Application 2003/0056943 illustrate composite type heat exchangers using fins to form channels for the fluids involved.

U.S. Pat. Nos. 5,655,600 and 5,845,399 describe a parallel plate exchanger utilizing composite materials which are stacked on pins to form the requisite passageways to effect heat exchange of fluids.

Although many attempts have taken place, problems of porosity of carbon fiber materials and subsequent plate leakage has occurred under actual operating temperatures and pressures. Thus, heat exchangers of this type have been deemed as unreliable for use in vehicles.

A reliable radiator structure using carbon fiber material would be a notable advance in the mechanical arts.

BRIEF SUMMARY OF THE INVENTION

In accordance with the present invention a novel and useful radiator structure is herein provided.

The radiator structure of the present invention utilizes a hot fluid and a cooling fluid. The structure includes a first carbon fiber tube having a wall portion which includes an inner surface and an outer surface. The wall portion forms a passageway with an entrance and an exit for the hot fluid, which may be coolant in a vehicle engine. The second carbon fiber tube is similarly constructed and is spaced from the first carbon fiber tube. In general, the first and second carbon tubes may be positioned in an essentially parallel arrangement.

A plurality of carbon fiber fins formed of a thin sheet of carbon fiber material span the first and second tubes. For example, a first carbon fiber fin may have a first end portion connected to the first tube outer wall, a second end portion connected to the second tube outer wall, and an intermediate portion therebetween. The intermediate portion may be roughened and include an uneven edge to induce turbulence in the flowing cooling fluid. A second carbon fiber fin, similarly constructed to the first carbon fiber fin, spans the first and second tubes and forms a cooling fluid passageway relative to the first carbon fiber tube. Most importantly, the first and second fins are adhered to the outer surface of the first and second tubes by a conductive adhesive, such as an epoxy impregnated with a conductive material. Of course, a number greater than two tubes and two fins may be employed commensurate with the need for heat removal from the hot fluid.

In certain structures, a carbon fiber plate may interpose the conductive adhesive and the plurality of fins spanning first and second tubes. In such a case, each fin end portion would connect to a particular plate which in turn would be fastened to the outer surface of a particular tube by the conductive adhesive. The fins would be fastened to the plates through fabrication process, apart from the use of an adhesive.

The tube and fin structure hereinabove described, may be placed in a housing which includes an entrance, an exit, and sufficient baffling to direct the hot fluids through the tubes, and yet allow the cooling fluid to pass through on the fins. As the radiator structure uses carbon fiber material, it has been found that the thermal conductivity of the same is ample to conduct heat from the inner wall of the tubes, through the wall of the tubes, to the heat conductive adhesive, and to the heat conductive fins in a very efficient manner.

In addition the fins may be oriented in a non-orthogonal manner to the tubes in order to adjust and maximize the heat exchange capability of the structure.

It may be apparent that a novel and useful radiator structure has been hereinabove described.

It is therefore an object of the present invention to provide a radiator structure which uses carbon fiber material in its entirety.

Another object of the present invention is to provide a radiator structure which uses carbon fiber material and possesses strength and integrity for use in vehicle radiators at relatively high temperatures and pressures.

Another object of the present invention is to provide a radiator structure using carbon fiber material which possesses a heat removal efficiency that is higher than prior metallic radiators.

Another object of the present invention is to provide a radiator structure of composite material such as carbon fiber which possesses a very high efficiency and permits the redesign of the front portion of a vehicle for the sake of style or a reduction in wind resistance i.e. aerodynamic efficiency.

Another object of the present invention is to provide a radiator structure which employs a high degree of carbon-carbon material without leakage or mechanical failure under conditions of high temperature and pressure.

Another object of the present invention is to provide a radiator structure which is employable in a vehicle and possesses reduced weight with respect to prior art metallic and metallic/composite radiators.

Another object of the present invention is to provide a radiator structure which uses carbon/carbon material which possesses very little degradation due to corrosive processes.

Yet another object of the present invention is to provide a radiator structure possessing fins of carbon fiber material which are less susceptible of occluding passageways for the cooling fluid than the prior art metallic fins.

Another object of the present application is to maximize the heat exchanging capacity of the structure of the present application by adjusting the area of the fins.

The invention possesses other objects and advantages especially as concerns particular characteristics and features thereof which will become apparent as the specification continues.

For a better understanding of the invention reference is made to the following detailed description of the preferred embodiments thereof which should be taken together with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove delineated drawings.

Figure 1:
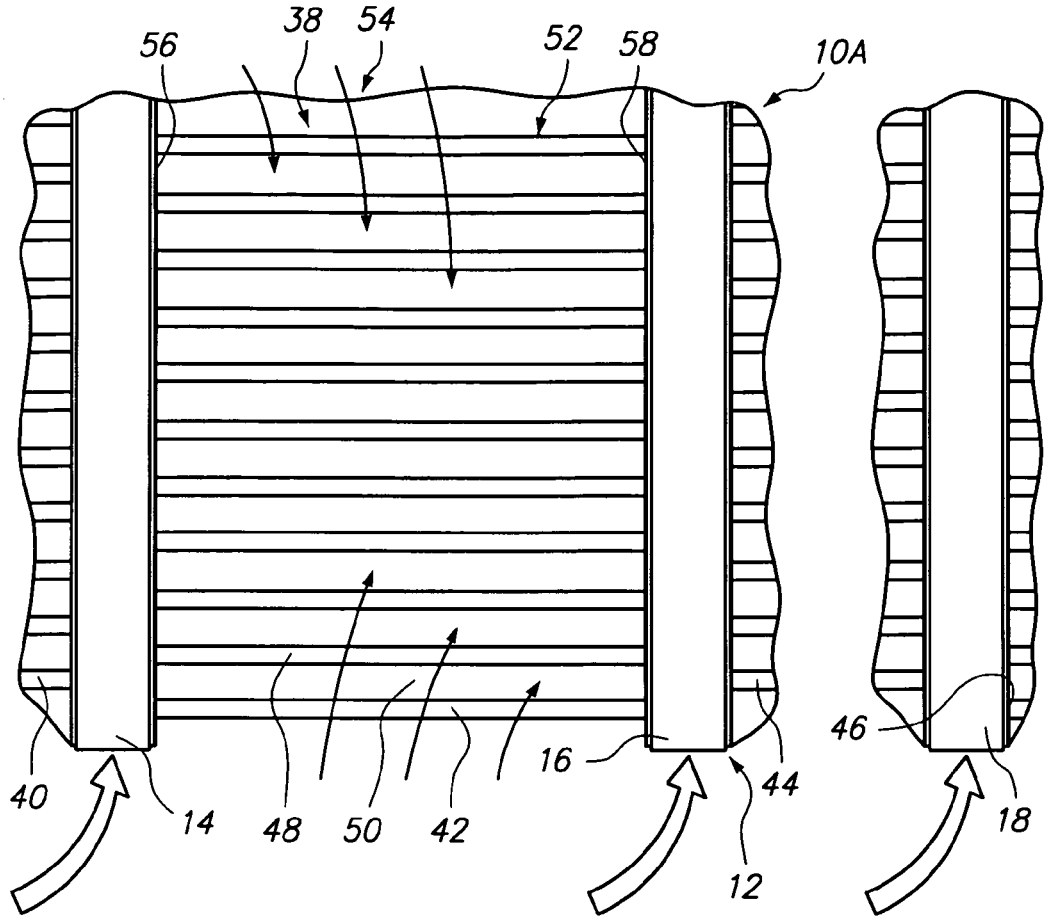
FIG. 1 is a top plan view of a portion of a radiator utilizing the structure of the present invention.
Figure 2:
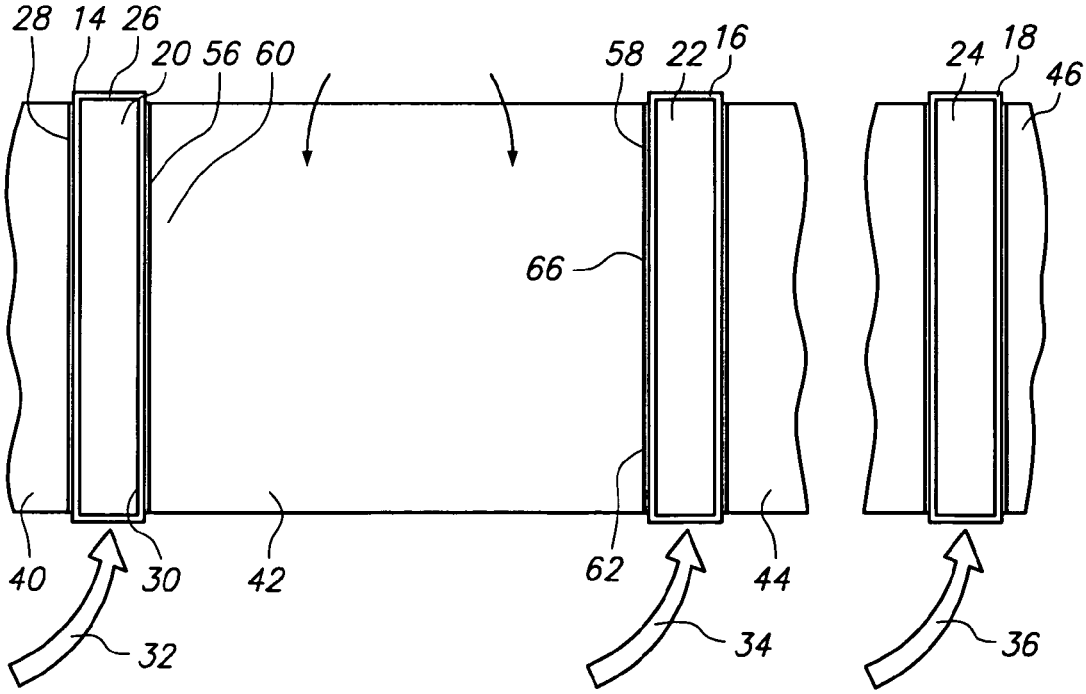
FIG. 2 is a front elevational view of the radiator structure depicted in FIG. 1.

The embodiments of the invention as a whole are shown by the reference character 10 followed by an uppercase letter to denote variations thereof. With respect to FIGS. 1 and 2, a radiator structure 10A is depicted. Structure 10A includes as one of its elements a plurality of tubes 12 formed of carbon fiber material. For example, tubes 14, 16, and 18 are shown on FIG. 1 and lie in a generally parallel configuration. Each tube 14, 16, and 18, possesses a rectangular passageway such as passageways 20, 22, and 24 of FIG. 2. Each of the plurality of tubes 12 is formed of a carbon fiber-material such as a carbon impregnated with epoxy and originating from an organic source.

With respect to exemplary tube 14, wall portion 26 surrounds chamber 20. Wall portion 26 includes an outer surface 28 and an inner surface 30, which contacts the hot fluid. Directional arrows 32, 34, and 36, show the intended route of hot fluid which is to be cooled by the radiator structure 10A of the present invention. Needless to say, hot fluid travels through passageways 20, 22, and 24 of tubes 14, 16, and 18 depicted in FIGS. 1 and 2. The thickness of wall 16 may vary between 250 microns to 300 microns.

Again with reference to FIGS. 1 and 2, it may be observed that a plurality of fins 38 span plurality of tubes 12. Specifically, fins 40, 42, 44, and 46 are depicted relative to tubes 14, 16, and 18 respectively. Each fin may possess a thickness of 50-75 microns. Fin 42 is shown in its entirety while fins 40, 42, 44, and 46 are only depicted partially in the drawings. Moreover, each of the plurality of tubes 38 of essentially identical to one another. In addition, fin 48 is depicted in its entirety on FIG. 1 and lies in spaced relationship relative to fin 42. A channel 50 is formed between fins 42 and 44 in this regard. It should be noted that fins 40 and 44 each lie along an axis between the axes of fins 42 and 40.

It should be apparent that a plurality of channels 52 are formed by plurality of fins 38 which are spaced from one another between pluralities of tubes 12. Plurality of directional arrows 54 depict the intended movement of the cooling fluid through plurality of channels 52. Each fin of plurality of fins 38 may be formed of carbon/carbon fiber which exhibits extremely high thermal conductivity. In addition, heat conductive adhesive layers 56 and 58 connect end portions 60 and 62 of fin 42 to outer wall 28 of tube 14 and to outer wall 66 of tube 16. Adhesive layers 56 and 58 also connect fin 48 to tubes 14 and 16 in the same manner. It should be realized that other heat conductive adhesive layers on tubes 14, 16, and 18, as well as the remaining plurality of tubes 12 serve to hold plurality of fins 38 in the places depicted in FIGS. 1 and 2. Each adhesive layer, such as layer 56, may be formed of an epoxy material embedded with a conductive material and may be 50-200 microns thick. The adhesive layers may be formed to hold any of the plurality of individual fins 52 to the outer walls of the plurality of tubes or may be formed as a continuous layer, as depicted in the drawings.

Figure 3:
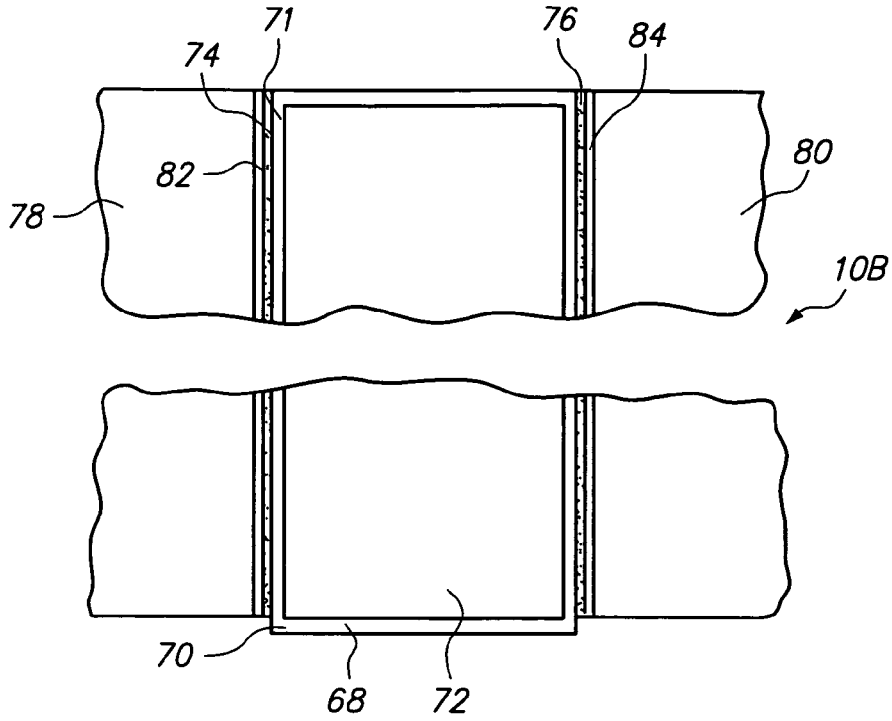
FIG. 3 is an enlarged, broken view of a tube and a pair of fins employed in an alternate embodiment of the present invention.

Turning to FIG. 3, it may be seen that another embodiment 10B of the present invention is shown. In this regard, a tube 68, similar to tubes 14, 16, and 18, is depicted in an enlarged format. Tube 68 includes a wall portion 70 forming a passageway 72 to conduct the hot fluid being cooled in the radiator 10B of the present invention. Outer surface 71 of wall portion 70 includes a heat conductive adhesive layers 74 and 76. Fins 78 and 80 are fastened to plates 82 and 84 during a normal fabrication process. Plates 82 and 84 are fabricated of carbon fiber material, such as carbon/carbon material. Thus, heat emanating from the fluid traveling through passageway 72 passes through wall 70, heat conductive adhesive 82, plates 82 and 84, and to fins 78 and 80, respectively.

Figure 4:
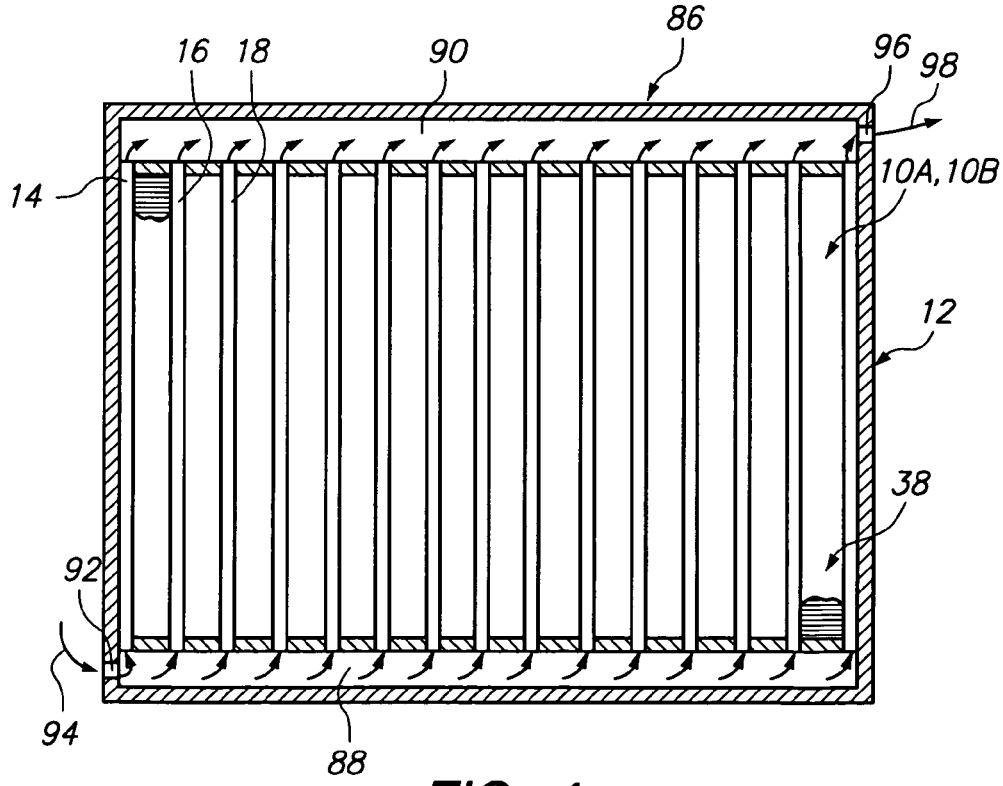
FIG. 4 is a top sectional view of a housing structure incorporating the radiator structure of the present invention.

Turning now to FIG. 4, it may be observed that a radiator assembled according to the structure of radiators 10A or 10B has been placed in a housing 86 having a lower tank 88 and an upper tank 90. Entrance 92 to housing 86 allows hot fluid, directional arrow 94, to travel into tank 88 and pass through any one of the plurality of tubes 12 and into tank 90 after heat is dissipated through the plurality of fins 38 (shown partially in FIG. 4). The cooled fluid then passes through exit 96 indicated by directional arrow 98. It should be noted that plurality of fins 38 are partially depicted in FIG. 4 for the sake of clarity.

Figure 5:
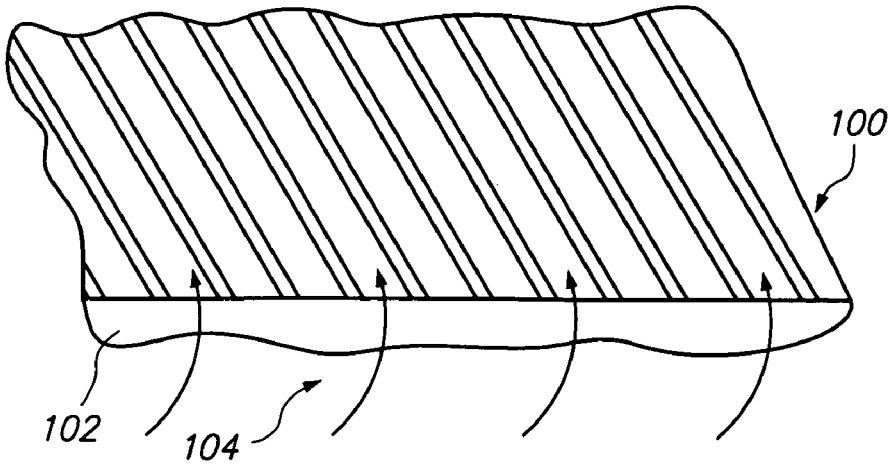
FIG. 5 is a partial side view of another embodiment of the present application showing a novel fin arrangement.
Figure 6:
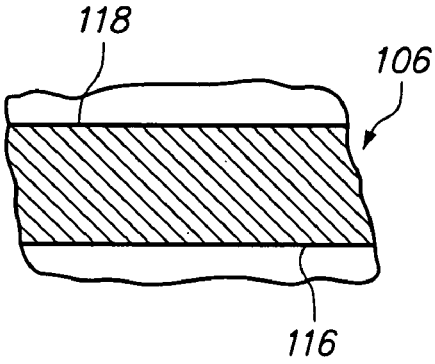
FIG. 6 is a schematic view of an alternate fin arrangement.
Figure 7:
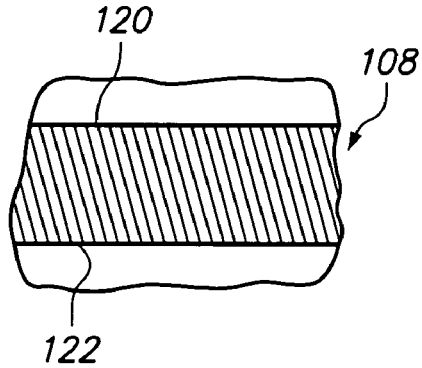
FIG. 7 is a schematic view of an alternate fin arrangement.
Figure 8:
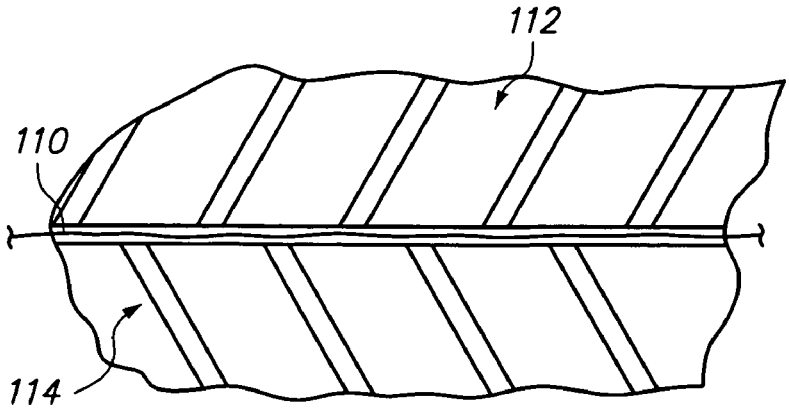
FIG. 8 is an enlarged partial side view of a side-by-side fin arrangement.

Turning to FIG. 5, it may be observed that plurality of fins 100 are connected to a tube 102 in a non-orthogonal manner. It should be understood that plurality of fins 100 span between tube 102 and another not shown. In this slanted arrangement, the surface area of the intermediate portions of plurality of fins 100 has been maximized to contact the cooling fluid passing through the fins noted by plurality of directional arrows 104. Turning to FIGS. 6 and 7, it should be noted that plurality of fins 106 and plurality of fins 108, FIGS. 6 and 7 respectively, vary in angle. That is to say, plurality of fins 106 of FIG. 6 present a larger surface area to the cooling fluid than the fins 108 of FIG. 7. FIG. 8 illustrates that fins between cooling tube 110 (broken) are shown offset from one another. That is to say plurality of fins 112 are offset from plurality of fins 114 near cooling tube 110. The arrangements shown in FIGS. 5-8 may also be used with heat conductive adhesive layers 116 and 118 of FIG. 6, as well as heat conductive adhesive layers 120 and 122 of FIG. 7.

In operation, the user connects radiator 10A or 10B to a source of hot fluid. Hot fluid is sent through any or all of the plurality of tubes 12 such as in the arrangement shown in housing 86 of FIG. 4. Each fin of the plurality of fins 38 is heat conductively attached to each of the heat conductive tubes of plurality of tubes 12, such that heat passes through the passageway of each tube, e.g. passageway 20 of tube 14. In this manner, heat from the hot fluid flowing through passageway 20 of exemplar tube 14 transfers from the hot fluid, through wall 26, adhesive layer 56, and to fin 42 of plurality of fins 38. The same heat transfer occurs with respect to each of the plurality of tubes 12 and the plurality of fins 38 shown in FIGS. 1 and 2. With respect to embodiment 10B of FIG. 3, heat also passes through an intermediate plate, such as plate 82, before moving into a particular fin such as fin 78. In this manner, heat is removed from the hot fluid since each fin allows the circulation of cooling fluid such as air, water, alcohol, and the like. Directional arrows 54 indicate the circulation of such cooling fluid with respect to embodiment 10A. The same circulation occurs with respect to embodiment 10B and the housing mounted unit depicted in FIG. 4.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A radiator structure used with a hot fluid and cooling fluid, comprising:

a. a first carbon fiber tube having a wall portion, said wall portion forming a passageway including an entrance thereto and an exit therefrom for the hot fluid;

b. a second carbon fiber tube having a wall portion, said wall portion forming a passageway including an entrance thereto and an exit therefrom for the hot fluid;

c. at least a first carbon fiber fin having a first end portion, a second end portion, and an intermediate surface therebetween, said first carbon fiber fin contacting the cooling fluid;

d. a first heat conductive adhesive body positioned between and linking said first end of said first carbon fiber fin to said outer surface of said first carbon fiber tube; and e. a second heat conductive adhesive body positioned between and linking said second end of said first carbon fiber fin to said second carbon fiber tube.

2. The structure of claim 1 which additionally comprises a second carbon fiber fin having a first end portion, a second portion, and an intermediate surface therebetween and further comprises a third heat conductive body positioned between and linking said first end of said second carbon fin to said first carbon fiber tube and a fourth heat conductive adhesive body positioned between and linking said second end of said second carbon fiber fin to said second carbon fiber tube.

3. The structure of claim 2 in which said first and third heat conductive adhesive bodies comprise a unitary member.

4. The structure of claim 2 in which said second and fourth heat conductive adhesive bodies comprise a unitary member.

5. The structure of claim 2 in which said intermediate portions of said first and second carbon fiber fins possess a substantially identical dimension between said first and second carbon fiber tubes.

6. The structure of claim 1 in which said first carbon fiber fin intermediate portion includes a roughened surface.

7. The structure of claim 2 in which said first and second carbon fiber fin intermediate portion includes a roughened surface.

8. The structure of claim 6 in which said first carbon fiber fin intermediate portion includes an edge portion of uneven configuration.

9. The structure of claim 6 in which said first and second carbon fiber fins intermediate portion include an edge portion of uneven configuration.

10. The structure of claim 2 in which said first carbon fiber tube and said second carbon fiber tube are substantially parallel to one another.

11. The structure of claim 2 which additionally comprises a housing having a chamber, said first and second carbon fiber tubes and said first and second carbon fiber fins being positioned within said chamber of said housing, and further comprising means for directing hot fluid through said first and second carbon fiber tubes and for directing cooling fluid along and in contact with said first and second carbon fiber fins.

12. The structure of claim 2 which further comprises a third carbon fiber fin and a fifth heat conductive adhesive body, said fifth heat conductive adhesive body linking said first end portion of said third carbon fiber fin to said first carbon fiber tube apart from said first and second adhesive bodies.

13. The structure of claim 12 in which said first and third heat conductive bodies comprise a unitary member.

14. The structure of claim 13 in which said second and fourth heat conductive adhesive bodies comprise a unitary member.

15. The structure of claim 12 in which said intermediate portions of said first and second carbon fiber fins possess a substantially identical dimension between said first and second carbon fiber tubes.

16. The structure of claim 12 in which said first carbon fiber fin intermediate portion includes a roughened surface.

17. The structure of claim 16 in which said second carbon fiber fin intermediate portion includes a roughened surface.

18. The structure of claim 17 in which said first carbon fiber fin intermediate portion includes an edge portion of uneven configuration.

19. The structure of claim 18 in which said second carbon fiber fin intermediate portion includes an edge portion of uneven configuration.

20. The structure of claim 12 in which said first carbon fiber tubes and said second carbon fibers are substantially parallel to one another.

21. A radiator structure used with a hot fluid and cooling fluid, comprising:

a. a first carbon fiber tube having a wall portion, said wall portion forming a passageway including an entrance thereto and exit therefrom for the hot fluid;

b. a second carbon fiber tube having a wall portion, said wall portion forming a passageway including an entrance thereto and an exit therefrom for the hot fluid; and c. at least a first carbon fiber fin having a first, end portion and a second end portion, said first end portion of said first carbon fiber fin being connected to said first carbon fiber tube at a non-orthogonal angle, said second end portion of said first carbon fiber fin being connected to said second carbon fiber tube at a non-orthogonal angle.

22. The structure of claim 21 which additionally comprises a second carbon fiber fin spaced from said one carbon fiber fin, said second carbon fiber fin including a first end portion and a second end portion, said first end portion of said second carbon fiber fin being connected to said first carbon fiber tube at a non-orthogonal angle, said second end portion of said second carbon fiber fin being connected to said second carbon fiber tube at a non-orthogonal angle.

23. The structure of claim 22 in which said first carbon fiber fin is substantially parallel to said second carbon fiber fin.

24. The structure of claim 21 which additionally comprises a first heat conductive adhesive interposed said connection between said first end portion of said first fin and said first tube, and a second heat conductive adhesive interposed said connection between said second end portion of said first fin and said first tube.

* * * * *